United States Patent [19]

Lutzke

[11] Patent Number: 4,907,522

[45] Date of Patent: Mar. 13, 1990

[54] MOORING APPARATUS

[76] Inventor: John M. Lutzke, 3831 S. Gleaner, Saginaw, Mich. 48603

[21] Appl. No.: 300,378

[22] Filed: Jan. 23, 1989

[51] Int. Cl.[4] ..... B63B 21/04

[52] U.S. Cl. ..... 114/230; 70/49; 70/57; 70/58

[58] Field of Search ..... 114/230; 70/57, 58, 70/30, 49, 164

[56] References Cited

U.S. PATENT DOCUMENTS

| | | | |
|---|---|---|---|
| 2,155,043 | 4/1939 | Gorskey | 114/230 |
| 3,007,331 | 11/1961 | Irwin | 70/57 |
| 3,101,695 | 8/1963 | Honeyman | 114/230 |
| 3,349,745 | 10/1967 | Berg | 114/230 |
| 3,817,064 | 6/1974 | Sallee | 70/58 |
| 4,070,879 | 1/1978 | Thompson | 70/49 |
| 4,232,537 | 11/1980 | Plaiss | 70/49 |
| 4,776,188 | 10/1988 | Dalaba et al. | 70/57 |

*Primary Examiner*—Sherman D. Basinger
*Assistant Examiner*—Thomas J. Brahan
*Attorney, Agent, or Firm*—John J. Swartz

[57] ABSTRACT

A mooring device for mooring an object, such as a boat, including a vertical support post mounting a transverse bar having openings in the terminal end portions thereof for detachably receiving the opposite terminal ends of a mooring line secured to the boat. A security cover, detachably mounted atop the support post is juxtaposed above the terminal ends to preclude their unauthorized removal from the transverse bar openings.

14 Claims, 1 Drawing Sheet

MOORING APPARATUS

BACKGROUND OF THE INVENTION

Field of the Invention

This invention relates to mooring apparatus and more particularly to apparatus, including anti-theft mechanism, for securely mooring a vehicle or vessel such as a boat.

Unattended vehicles or vessels, such as boats, which are moored for extended periods of time, are prime subjects of theft. For example, boats, which are moored at cottages that might be visited only on weekends, can easily be untied from normal moorings and carried or driven away. Accordingly, it is an object of the present invention to provide a mooring system for not only mooring a boat but one which will provide additional security to inhibit theft.

It is another object of the present invention to provide a mooring system which will provide increased security against tampering.

It is yet another object of the present invention to provide morring apparatus which includes anti-theft mechanism to preclude unauthorized removal of a mooring line from a mooring post.

Apparatus constructed according to the present invention includes a flexible mooring line, coupled to a boat, having rigid or stiffened pins at the terminal ends thereof which are received in apertures provided in a crossbar that is fixed atop a support post. The lower end of the support post is suitably implanted in the floor of the body of water in which the boat is floating. A cover, detachably secured atop the post to conceal the ends of the line, is positioned such that the line cannot be removed from the crossbar until the cover is detached from the post.

Accordingly, it is another object of the present invention to provide mooring apparatus of the type described which includes a security cover for selectively preventing removal of the ends of a mooring line from ground embedded anchoring apparatus. The following United States Patents are cited as being of interest to this construction although none of the patents, taken singly or in combination disclose applicant's construction:

| U.S. PAT. NO | PATENTEE | ISSUE DATE |
|---|---|---|
| 224,083 | S. M. Furman | Feb. 03, 1880 |
| 458,737 | J. Massey | Sep. 01, 1891 |
| 2,084,239 | B. H. Bradford | Jun. 15, 1937 |
| 2,360,199 | C. J. Cawley | Oct. 10, 1944 |
| 3,054,583 | J. F. Deye | Sep. 18, 1962 |
| 3,349,745 | L. A. Berg | Oct. 31, 1967 |
| 3,455,270 | J. Mascenik et al | Jul. 15, 1969 |
| 3,495,565 | E. V. Gustavii | Feb. 17, 1970 |

Other objects and advantages of the present invention will become apparent to those of ordinary skill in the art as the description thereof proceeds.

SUMMARY OF THE INVENTION

Mooring apparatus including: a mooring line for coupling to an object, such as a boat, to be moored; pins fixed to opposite ends of the line; a vertical support adapted to be implanted in the underwater surface; a transverse bar mounted on the support including a pair of receptacles on laterally opposite sides of the vertical support for releasably receiving, through the upper ends thereof, the pins; and an open bottom security dome detachably rotatably mounted on the vertical support and overlying the transverse bar in such position as to prevent the pins from being removed from the receptacles.

BRIEF DESCRIPTION OF THE DRAWINGS

The invention may be more readily understood by referring to the accompanying drawings, in which.

DESCRIPTION OF PREFERRED EMBODIMENT

Figure 1:
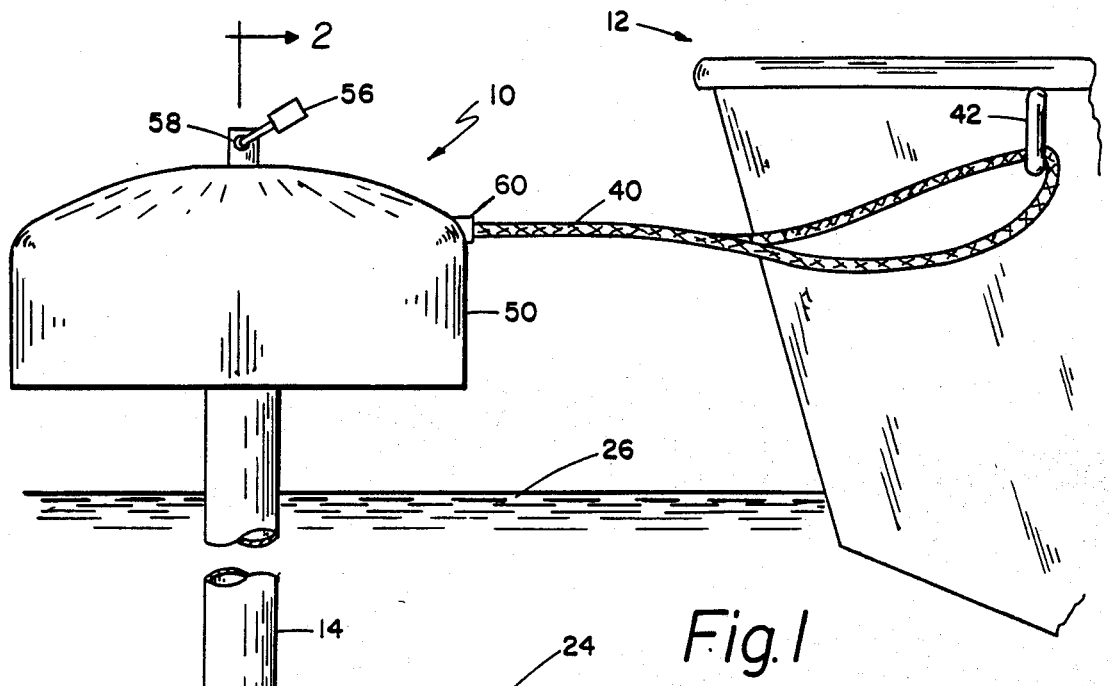
FIG. 1 is a side elevational view illustrating mooring apparatus constructed according to the present invention.

Apparatus, generally designated 10, construction according to the present invention, is particularly adapted for use in mooring a boat or other object, generally designated 12.

The mooring apparatus 10 comprises an upstanding hollow metal pipe 14 having a screw 16 detachably coupled to the lower end thereof via an upstanding stub-shaft 18 and a transverse pin 22. The screw 16 is turned into the underwater floor 24 of a lake, sea, or ocean, having a water level generally designated 26, in which the boat 12 floats.

Mounted on the upper end of the pipe 14 is a transverse crossbar 28 having a dependent stub-shaft 30 received by the upper end of the pipe 14 and fixed thereto via a pin 32.

The bar 28 includes a pair of vertical passages or apertures 35 therethrough in the distal ends thereof for a purpose to become immediately apparent.

A flaccid mooring line, such as a rope generally designated 40, is received in a hasp 42 which is coupled to the boat 12. A pair of stiff or rigid pins or nails 36 are fixed to opposite ends 40A and 40B of line 40 for vertical insertion into the apertures 35 through the upper ends thereof.

The pins 36 each includes an enlarged diameter head 35 and a reduced diameter elongate body portion 37 having a terminal end 39. Extending upwardly from the crossbar 34 is a central post or bar 44 in axial alignment with the vertical mooring post 14. An annular mounting flange 45 is fixed to the central post 44 for a purpose to become immediately apparent. The diameter of pin heads 35 is greater than the diameter of bar apertures 35 to prevent their passage therethrough.

A downwardly opening security dome, generally designated 50, is mounted on the support flange 45 and includes an upper end wall 48 having a central opening 46 therein which receives the post 44. The dome 50 also includes an annular skirt or sidewall 52 having an annular terminal edge 53 which is disposed at a level substantially below the lower terminal pin ends 30 of the line pins 36.

The dome 50 is of such construction and is so positioned on the mounting flange 45 that, when the pins 36 are fully inserted into apertures 36 as illustrated, the distance d between the upper surface 51 of the pinhead 35 and the under surface 53 of the dome 50 is less than the distance D between the underside 55 of the pinhead 35 and the terminal end 39 of the pins 36. Also, the vertical distance d is less than the length 1 of rigid pins 36. Likewisely, the vertical distance D1 between the crossbar 28, adjacent apertures 35, and the underside of the dome 50 is less than the length 1 of pins 36.

The dome 50 is held in place and selectively prevented from being vertically removed via a suitable security device such as a conventional padlock 56 which is received in aperture 58 provided in the upper end of the post 44 above the outer surface of the dome base 48. The pins 36 can not be moved upwardly out of the recesses 35 unless the lock 56 and the dome 48 are removed. Thus, a thief will be precluded from removing the stiffened line pins 36 from bar 28 and thus the mooring line 40 will remain coupled to the boat and mooring device 10.

The mooring line 40 passes through a line receiving opening 60 provided in the dome sidewall 52.

If desired, the pins 36, rather than being attached to opposite ends of mooring line 40 could be welded or otherwise suitably fixed to the top surface of transverse bar 28. In such case, the opposite ends of mooring line 40 would be fixed to annular loops (not shown) which pass over and are received by the pins. The dome 50 would be so positioned that the vertical thickness of the loops would be less than the distance between the upper ends of the pins 36 and the underside of the dome 50.

THE OPERATION

With the dome 50 and mooring line 40 removed, the vertical support post 14 is preferably turned into the underwater earth surface 24 at a location relative to the mooring position of boat 12 such that the pins 36 can be received in the apertures 34 and yet the line 40 remains substantially taut without a great amount of slack therein.

The mooring line 40 is passed through the boat hasp 42 and the opposite line ends 40A and 40B are passed through the dome sidewall opening 60. The mooring line terminal pins 36 are inserted into the apertures 34 in the position illustrated in FIG. 2.

Figure 2:
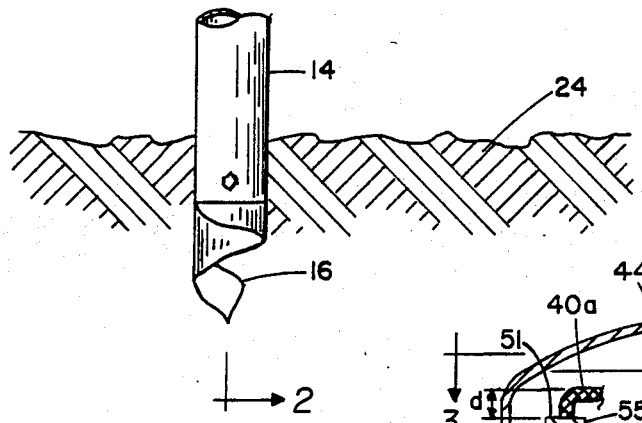
FIG. 2 is a sectional end elevational view of apparatus constructed according to the present invention, taken along the line 2—2 of FIG. 1.
Figure 2:
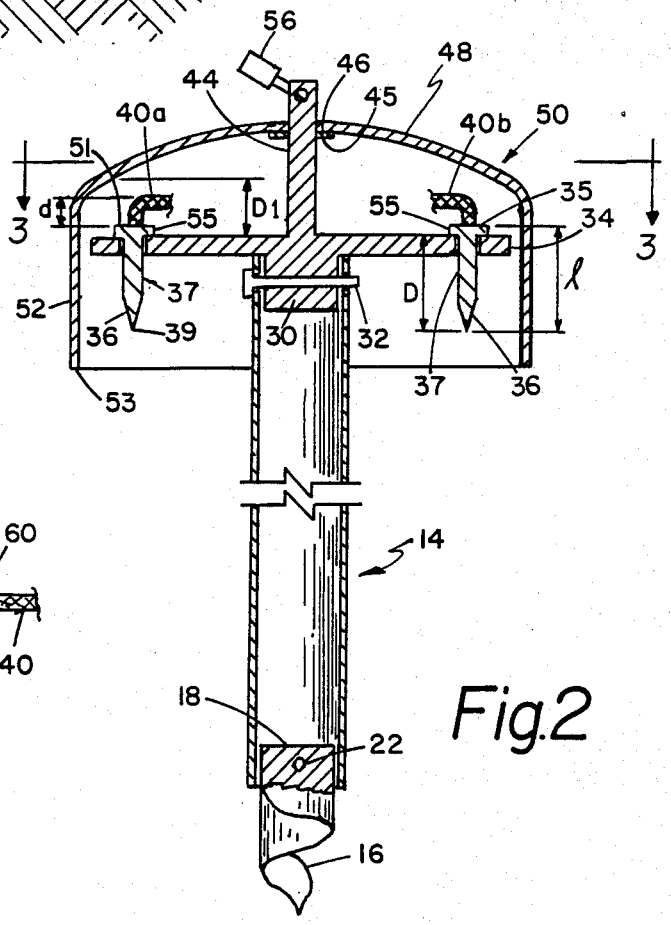
Figure 3:
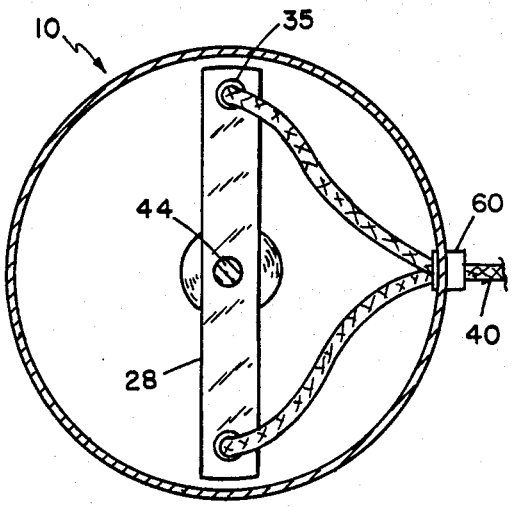
FIG. 3 is a top plan sectional view, taken along the line 3—3 of FIG. 2.

The cover dome 50 is then moved to the position illustrated in FIG. 2 and the lock 56 installed.

With the parts positioned as illustrated in FIG. 2, the pins 36 cannot be removed from the locking or secured positions illustrated in FIG. 2. If a thief attempts to remove the pins 36 the upper pin head surfaces 51 will strike the underside dome surface 48 before the terminal pin ends 39 clear the upper surface 35 of crossbar 34. The pins cannot be removed and thus theft is prevented.

Any tugging or turning on the bar 28 by the boat 12 will produce an equal and opposite torque on the diametrically opposite ends of the bar 34 and thus, the shaft 14 will remain turned into the underwater surface 24.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. Mooring apparatus comprising a flaccid mooring line for coupling to an object, such as a boat, to be moored;

rigid pin means fixed to opposite ends of said line;

vertical support means, adapted to be implanted in a surface;

transversely extending means mounted on said support means including receptacle means on laterally opposite sides of said vertical support means for releasably receiving, through the upper ends thereof, said pin means; and an open bottom security dome detachably rotatably mounted on said vertical support means and overlying said transversely extending means.

2. The apparatus set forth, in claim 1, wherein said dome includes an annular sidewall having an opening therethrough receiving said mooring line.

3. The apparatus set forth in claim 1 wherein said dome includes an annular skirt having a lower edge disposed at a level below said transversely extending means.

4. The apparatus set forth in claim 3 wherein said skirt has an aperture therein through which said mooring line passes.

5. The apparatus set forth in claim 1 wherein said transversely extending means comprises a transverse bar;

said receptacle means comprises vertical aperture means in said bar on laterally opposite sides of said vertical support means for receiving said rigid pin means.

6. The apparatus set forth in claim 5 wherein the vertical distance between the underside of said dome and said transverse bar, adjacent said receptacle, is less than the length of said rigid pin means.

7. The apparatus set forth in claim 5 wherein said pin means comprise a pair of pins each having an enlarged diameter head attached to one end of said line and a reduced diameter elongate portion having a terminal end; and means for mounting said dome on said support means such that the vertical distance between the upper side of said enlarged diameter head and the underside of the dome is less than the distance between the underside of the head and said terminal end.

8. The apparatus set forth in claim 7 wherein said support means includes screw means at the lower end thereof for implanting in the surface below the level of water in which the object to be moored is floating;

said vertical support means being of such length that the upper end thereof projects over said water level; and latch means detachably secured to said support means to selectively preclude removal of said dome from said support means.

9. The apparatus set forth in claim 7 wherein said transverse bar is detachably secured to the upper end of said vertical support means.

10. The apparatus set forth in claim 9 wherein said support means includes a flange on the underside of said dome for vertically supporting said dome and an aperture on the upperside of said dome for releasably receiving a lock.

11. The apparatus set forth in claim 1 including means mounting said security on said support means in such position that the distance between the upper end of said pin means, when fully inserted in said receptacle means and the underside of said security dome is less than the length of said pin means.

12. Mooring apparatus comprising;

a flaccid mooring line for coupling to an object, such as a boat, to be moored;

vertical support means adopted to be implanted in the surface;

means for coupling said line to said vertical support means comprising a pair of pin means on one of said vertical support means or opposite ends of said line;

a pair of receptacle means on the other of said support means or opposite ends of said line for receiving said pin means;

an open bottom security dome detachably rotatably mounted on said vertical support means and overlying said pin means; and means mounting said security dome on said support means in such position that said pin means cannot be dislodged from said receptacle means.

13. The mooring apparatus set forth in claim 12 wherein said dome includes an annular skirt having a lower edge disposed at a level below said pin means.

14. The apparatus set forth in claim 13 wherein said skirt has an aperture for receiving said line.

* * * * *